US007413358B2

(12) United States Patent
Kawaguchi

(10) Patent No.: US 7,413,358 B2
(45) Date of Patent: Aug. 19, 2008

(54) ARMATURE DAMPER, METHOD OF MANUFACTURING ARMATURE DAMPER, AND DOT HEAD

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 229 days.

(21) Appl. No.: 11/369,156

(22) Filed: Mar. 6, 2006

(65) Prior Publication Data

US 2007/0065212 A1 Mar. 22, 2007

(30) Foreign Application Priority Data

Sep. 22, 2005 (JP) ..... 2005-276589

(51) Int. Cl.
*B41J 2/27* (2006.01)
*B41J 2/305* (2006.01)

(52) U.S. Cl. ..... 400/124.23; 400/124.11; 400/124.01

(58) Field of Classification Search ..... 400/124.22, 400/124.23, 124, 124.13, 124.01, 124.11, 400/124.24
See application file for complete search history.

(56) References Cited

U.S. PATENT DOCUMENTS

| | | | |
|---|---|---|---|
| 6,682,233 | B2 | 1/2004 | Terao et al. |
| 6,698,956 | B1 | 3/2004 | Terao et al. |
| 6,729,782 | B2 | 5/2004 | Ichitani et al. |
| 6,784,907 | B2 | 8/2004 | Terao et al. |
| 6,789,964 | B2 | 9/2004 | Kawaguchi |
| 6,848,843 | B1 | 2/2005 | Kawaguchi |
| 6,872,016 | B2 | 3/2005 | Kawaguchi |
| 6,994,482 | B2 | 2/2006 | Terao et al. |
| 7,008,126 | B2 | 3/2006 | Kawaguchi |
| 7,018,116 | B2 | 3/2006 | Tsuchiya et al. |
| 7,048,455 | B2 | 5/2006 | Kawaguchi et al. |
| 2003/0012590 | A1 | 1/2003 | Terao et al. |

(Continued)

FOREIGN PATENT DOCUMENTS

| | | |
|---|---|---|
| JP | 5-521 A | 1/1993 |

(Continued)

OTHER PUBLICATIONS

U.S. Appl. No. 11/369,154, filed Mar. 6, 2006; Inventor: Takahiro Kawaguchi; title: Dot Head and Method of Manufacturing Armature Structure for Dot Head.

(Continued)

*Primary Examiner*—Daniel J. Colilla
*Assistant Examiner*—M. L. Ferguson-Samreth
(74) *Attorney, Agent, or Firm*—Frishauf, Holtz, Goodman & Chick, P.C.

(57) ABSTRACT

An armature damper according to the present invention acts to abut against the arm of an armature to stop the arm at a predetermined backward position. The armature damper is formed in a manner that the surface thereof abutting against the arm is formed by a rigid body member and an elastic member is integrally joined to the rear surface of the rigid body member, and the elastic member is formed to protrude from the outer side of the rigid body member at least at the engaging portion between a positioning armature stopper and the armature damper. The protruded portion is used as a buffer at the engaging portion between the armature stopper and the armature damper.

3 Claims, 3 Drawing Sheets

U.S. PATENT DOCUMENTS

| | | | |
|---|---|---|---|
| 2005/0058488 | A1 | 3/2005 | Kawaguchi |
| 2005/0160576 | A1 | 7/2005 | Kawaguchi |
| 2005/0201797 | A1 | 9/2005 | Kawaguchi et al. |
| 2005/0201800 | A1 | 9/2005 | Tsuchiya et al. |
| 2005/0201801 | A1 | 9/2005 | Kawaguchi et al. |
| 2005/0207814 | A1 | 9/2005 | Kawaguchi |
| 2005/0207815 | A1 | 9/2005 | Terao et al. |
| 2005/0214052 | A1 | 9/2005 | Kawaguchi et al. |

FOREIGN PATENT DOCUMENTS

| | | | | |
|---|---|---|---|---|
| JP | 5-318779 | A | | 12/1993 |
| JP | 6-286168 | A | | 10/1994 |
| JP | 7-256898 | A | | 10/1995 |
| JP | 7-309022 | A | | 11/1995 |
| JP | 9-314868 | A | | 12/1997 |
| JP | 2000-249166 | | * | 9/2000 |
| JP | 2001-219586 | A | | 3/2005 |
| JP | 2005-75000 | A | | 3/2005 |
| JP | 2005075000 | | * | 3/2005 |

OTHER PUBLICATIONS

U.S. Appl. No. 11/369,153, filed Mar. 6, 2006; Inventor: Takahiro Kawaguchi; title: Armature Structure and Dot Head.

* cited by examiner

ARMATURE DAMPER, METHOD OF MANUFACTURING ARMATURE DAMPER, AND DOT HEAD

CROSS-REFERENCE TO RELATED APPLICATION

This application is based upon and claims the benefit of priority from prior Japanese Patent Application No. 2005-276589 filed on Sep. 22, 2005, the entire contents of which are incorporated herein by reference.

BACKGROUND OF THE INVENTION

1. Field of the Invention

The present invention relates to an armature damper used for a wire dot printer, a method of manufacturing the armature damper and a dot head using the armature damper.

2. Description of the Related Art

The wire dot printer is arranged to move a printing wire (hereinafter, simply referred to as a wire) called a needle forward and backward to strike the tip end of the wire against a print medium thereby to print a dot-shaped image thereon. Since the wire dot printer employs such the printing method, the wire dot printer can simultaneously print plural slips etc. in a stacked state and so is employed for business use. Although there are various kinds of methods as the printing method of moving the wire (needle) forward and backward, the method called a clapper type is generally employed. The clapper type has been employed widely since the structure thereof is simple and a relatively long stroke can be secured. Such the kind of the printing method is proposed by JP-A-2005-75000, for example.

The dot head of such the clapper type includes armatures each for driving a corresponding wire backward and forward. The armature is pivotally supported at a portion near the one end thereof so as to be rotatable. The armature is provided with an attracted portion opposing to a core, at the intermediate portion between the pivotally supported portion and the free end of the armature. An arm is extended from the free end of the armature so as to be integrated with the armature. A needle for printing is provided at the tip end of the arm. The needle is attached to the arm in a manner that the axial direction of the needle crosses with the longitudinal direction of the arm at the tip end of the arm. The armature and the arm integrally provided with the armature rotate in the operation direction around the pivotally supported portion when the attracted portion is attracted by the magnetic force generated by the core. When the armature and the arm integrally provided with the armature rotate in the operation direction in this manner, the needle provided at the tip end of the arm moves forward. In contrast, when the magnetic force having been generated by the core disappears, the armature and the arm integrally provided with the armature rotate in the restoring direction by a spring force etc. and so the needle moves backward.

The dot head is arranged in a manner that a plurality of the armatures each thus configured are disposed radially around a print portion.

The dot head is provided with an armature damper in corresponding to the armatures. At the time of the rotation of the armature in the restoring direction, that is, at the time of the rotation of the needle in the backward moving direction, the armature damper abuts against the one side of the arm thereby to stop the arm at a predetermined backward position while absorbing the rebounding operation of the arm. To this end, the armature damper is configured in an annular shape (doughnut shape) so as to oppose to the one sides of the respective arms of the plurality of armatures which are disposed radially. A plurality of outer peripheral projections for positioning are provided at the outer periphery of the annular armature damper. The plurality of outer peripheral projections engage with projections which are provided at the inner periphery of an armature stopper disposed in an annual shape on the outer periphery side of the armature damper. According to this engagement relation, the armature damper is positioned and fixed so as to oppose to the one sides of the respective arms of the plurality of armatures.

Heretofore, the outer peripheral projections of the armature damper are assembled to have a small clearance with respect to the projections of the armature stopper. Usually, since the armature damper abuts against the arms of the armatures, the armature damper is formed by a rigid body with a high intensity. Thus, even when the outer peripheral projections of the armature damper are formed with a high accuracy, it is substantially difficult to assemble in such a manner that the clearance between the outer peripheral projections of the armature damper and the projections of the armature stopper is made zero thereby to completely make them coincide. As a result, as described above, there is a quite small clearance between the outer peripheral projections of the armature damper and the projections of the armature stopper.

At the time of the printing operation, since the arm of the armature repeatedly abuts against the armature damper at a high speed, the armature damper vibrates. Thus, there may arise such a phenomenon that the armature damper having been engaged with the armature stopper via the clearance deviates positionally due to the vibration, whereby the outer peripheral projections of the armature damper deviate from the projections of the armature stopper and so the armature damper is damaged.

SUMMARY OF THE INVENTION

An object of the invention is to provide an armature damper which can eliminate a clearance between an armature damper and the projections of an armature stopper by utilizing an elastic member integrally joined to the rear surface of a rigid body constituting an abutment surface abutting against the arm of an armature thereby to prevent a damage due to vibration, and also provide a manufacturing method of the armature damper and a dot head using the armature damper.

According to an embodiment of the invention, an armature damper includes:

a rigid body member which includes an abutment surface and projections, the abutment surface abutting against an arm having a needle at a tip end thereof thereby to stop a movement of the arm with respect to a movement of an armature in a direction of moving the needle backward, the armature moving the needle via the arm forward and backward, and the projections being protrusively formed at a peripheral portion of the abutment surface and engaging with projections of an armature stopper for positioning, respectively; and an elastic member which is integrally joined to a rear surface of the abutment surface of the rigid body member and formed so as to protrude from outer sides of the projections of the rigid body member.

Further, according to the embodiment of the invention, a method of manufacturing an armature damper, includes the steps of:

integrally adhering an elastic member to a rear surface of a plate-shaped rigid body member; and stamping the rigid body member and the elastic member thus adhered integrally by a press processing to form the elastic member so as to protrude from an outer side of the rigid body member.

Furthermore, according to the embodiment of the invention, a dot head includes:

a plurality of armatures each of which is pivotally supported so as to be rotatable at a base end portion thereof and has an arm that is integrally formed with the armature and has a needle at a tip end thereof, the plurality of armatures being disposed radially in a state that the tip ends thereof are positioned at an inner side thereof, and each of the plurality of armatures rotating around the base end portion serving as a pivotally supporting portion to move the needle forward and backward;

a rigid body member of an armature damper formed in an annular shape so as to oppose to one sides of the respective arms of the plurality of armatures disposed radially, the rigid body member being provided at an outer periphery thereof with a plurality of outer peripheral projections for positioning, and the rigid body member abutting against the one side of the arm when the arm rotates in the backward direction of the needle to stop the arm at a predetermined backward position;

an armature stopper which is disposed in an annular shape at an outer peripheral side of the armature damper and has a plurality of projections engaging with the plurality of outer peripheral projections, respectively; and an elastic member which is integrally joined to a rear surface of the rigid body member of the armature damper, the elastic member being formed to protrude from an outer side of the rigid body member at least at an engaging portion between the projections of the armature stopper and the rigid body member.

DETAILED DESCRIPTION OF THE INVENTION

An embodiment of the invention will be explained in detail with reference to the accompanying drawings.

Figure 1:
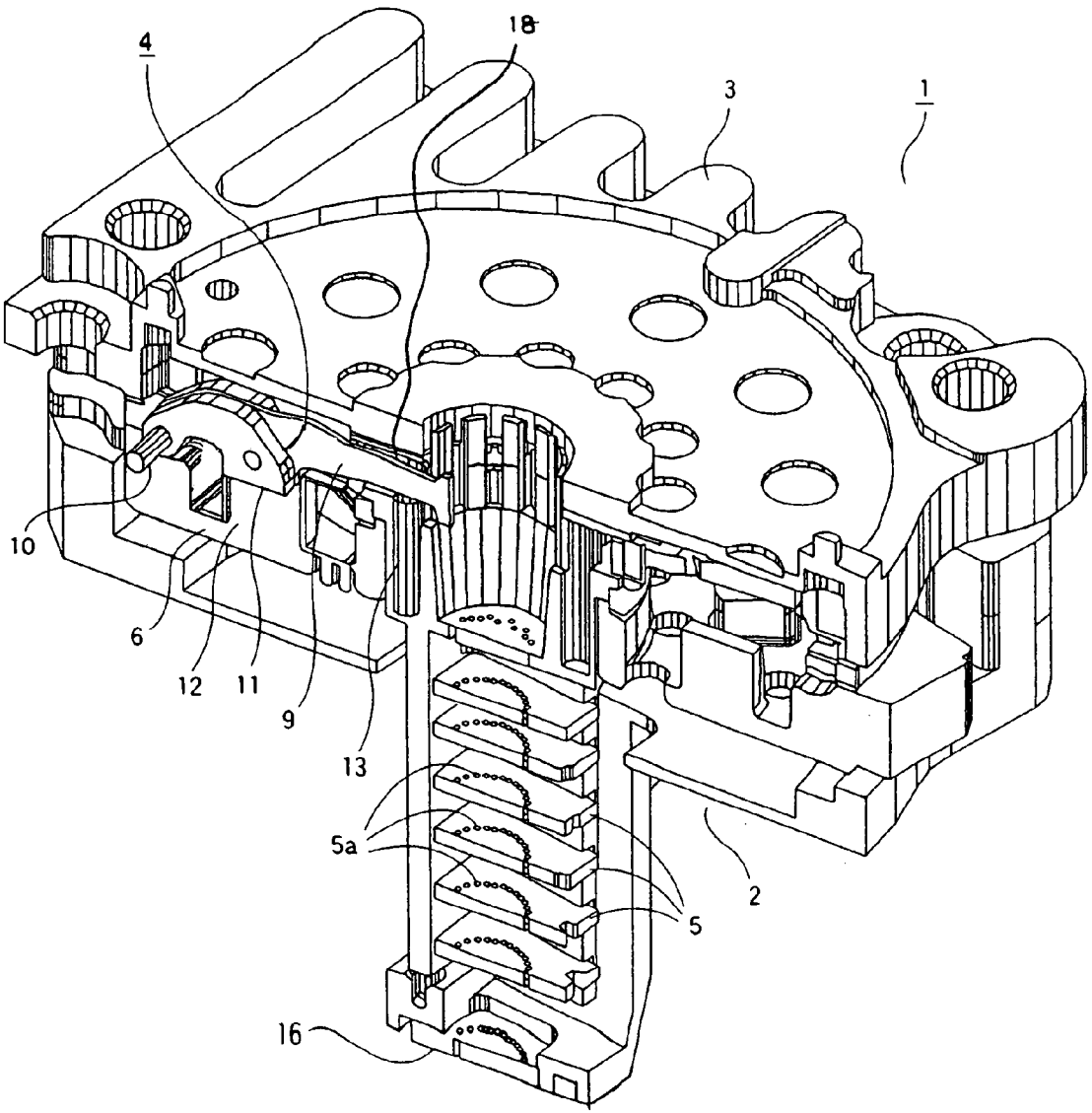
FIG. 1 is a perspective sectional view showing a dot head according to the first embodiment of the invention, in which the dot head is cut longitudinally along the center portion thereof.

First, the explanation will be made with reference to FIG. 1 as to the entire configuration of the dot head of a wire dot printer. FIG. 1 is a perspective sectional view schematically showing the dot head 1, in which the dot head is cut longitudinally along the center portion thereof.

The dot head 1 includes a front casing 2 and a rear casing 3 which are coupled by attachment screws (not shown) Armatures 4, wire (needle) guides 5 and yokes 6 etc. are provided between the front casing and the rear casing.

The armature 4 includes an arm 9 which is integrally provided with the armature and extended from the free end side (the right end side in the figure) of the armature. The armature 4 is provided with a fulcrum shaft 10 near the base end (the left end in the figure) thereof, whereby the tip end of the arm 9 can rotate so as to move in an arc manner by the fulcrum shaft 10. An attracted portion 11 is formed at the lower surface in the figure of the armature 4 in a manner that the attracted portion 11 opposes to a core 12 which is integrally provided with the yoke 6. That is, the yoke 6 is formed in an annular shape (doughnut shape) along the inner peripheries of the casings 2 and 3. The core 12 is integrally formed on the upper surface of the yoke 6 so as to oppose to the attracted portion 11 of corresponding one of the armatures 4.

A plurality of the armatures 4 are disposed radially with respect to the axle center (also serving as the center of a print portion) of the annular-shaped yoke 6. Each of these armatures 4 is supported on the upper surface of the yoke 6 in a state that the armature rotates freely around the fulcrum shaft 10 in the direction away from the yoke 6. Further, the armature is biased in the direction away from the yoke 6 by a not-shown spring within a cylindrical member 13 disposed at the lower portion on the tip end side of the arm 9.

A not-shown coil is wound around the core 12. When a current is supplied to the coil, the core 12 generates a magnetic attracting force to attract the attracted portion 11 of the armature 4. Thus, the armature 4 and the arm 9 integrally provided with the armature rotate in the operation direction, that is, clockwise in the figure around the fulcrum shaft 10.

A not-shown printing wire (needle) is attached by the hard soldering to the tip end of the arm 9. The wire is attached downward in the figure so that the axial direction thereof crosses with the longitudinal direction of the arm 9.

Thus, when the armature 4 and the arm 9 integrally provided with the armature rotate in the operation direction, that is, clockwise in the figure around the fulcrum shaft 10 by the magnetic attracting force generated by the core 12, the not-shown wire provided at the tip end of the arm 9 moves forward in the downward direction in the figure to the position where the tip end of the wire collides with a print medium such as a print sheet. When the magnetic force having been generated disappears, the arm moves backward in the restoring direction, that is, the upward direction in the figure by the repulsive force of the not-shown spring within the cylindrical member 13.

The wire guide 5 includes guide holes 5*a* through which not-shown wires pass so as to guide the wires forward and backward freely so that the tip end of each of the wires collides with a predetermined position of a print medium. The front casing 2 is provided with a tip end guide 16 which lines up the tip ends of the wires in a predetermined pattern and guides the wires forward and backward freely.

In this respect, when the magnetic force having been generated by the core 12 disappears, the armature 4 rotates in the restoring direction, that is, counterclockwise in the figure around the shaft 10 thereby to move the not-shown wire provided at the tip end of the arm 9 backward (restoring direction), that is, the upward direction in the figure. Thus, in the upward direction in the figure of the armature 4 and the arm 9 integrally provided with the armature 4, it is required to provide a part which stops the rotation of the armature in the restoring direction thereby to position the armature 4 and the arm 9 integrally provided with the armature 4 to a predetermined backward position (standby position). This part is called as an armature damper 18. As shown in FIG. 1, the armature damper is formed in an annular shape (doughnut shape) at the inside of the rear casing 3 so as to oppose to the one sides of the respective arms 9 of the armatures 4 disposed radially.

Figure 2:
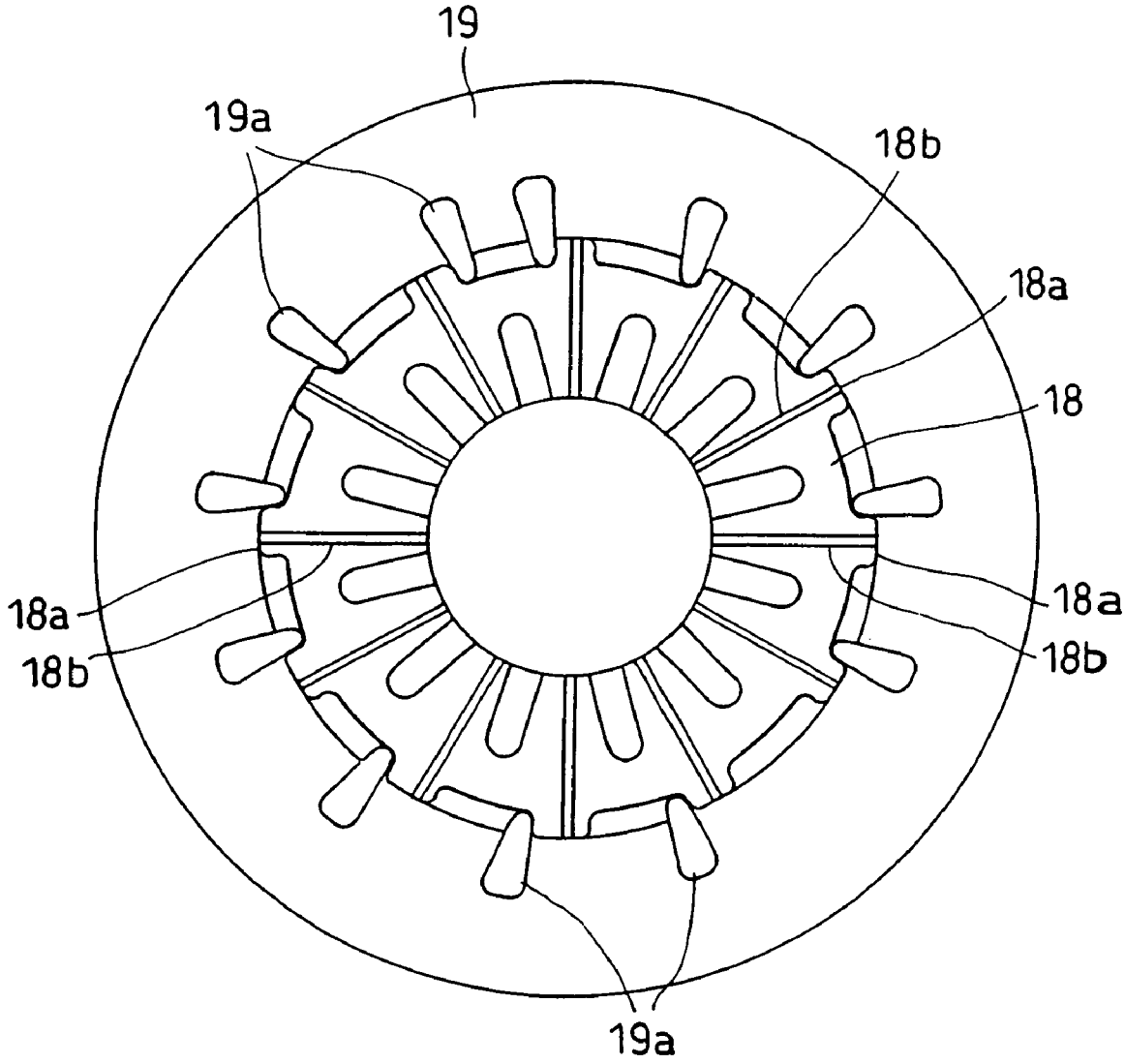
FIG. 2 is a plan view showing a relation between an armature damper and an armature stopper, according to the first embodiment of the invention.

As shown in FIG. 2, the armature damper 18 is provided at the outer periphery thereof with a plurality of outer peripheral projections 18*a* for positioning. A planer portion (formed in a shallow recess shape) 18*b* of the armature damper corresponding to the associated one the outer peripheral projections 18*a* abuts against the one side of the arms 9 thereby to stop the rotation of the arm in the backward moving direction of the needle to stop the arm 9 at the predetermined backward position.

An armature stopper 19 of an annular shape is disposed on the outer periphery side of the armature damper 18. The armature stopper 19 includes a plurality of projections 19*a* which are protrusively formed at the inner periphery thereof toward the center of the annular shape thereof. These projections 19*a* respectively engage with the one sides of the outer peripheral projections 18*a* provided at the armature damper 18 thereby to position and fix the armature damper 18 so as to be a predetermined positional relation.

The armature stopper 19 is formed by zinc die casting, for example, and the fixing projections 19*a* are formed with a high accuracy.

The armature 4 and the arm 9 integrally provided with the armature are required to have durability that they can move reciprocatively for about three hundred million strokes or more at a high printing frequency of 2,500 Hz. Thus, the armature damper 18 abutting against the arm 9 is required to have the intensity and the damping characteristics capable of securing the aforesaid printing efficiency and the durability. To this end, the armature damper 18 is arranged in a manner that the surface abutting against the arm 9 is formed by a rigid body member and a damping elastic member is integrally joined to the rear surface of the rigid body member. The rigid body member is made from stainless material SUS301-SEH (surface hardness of Hv 500 or more), for example. The elastic member is made from fluorine-contained rubber with a thickness of 0.15 mm, for example. The rigid body member and the elastic member are integrally joined by silane-contained adhesive agent.

Figure 3:
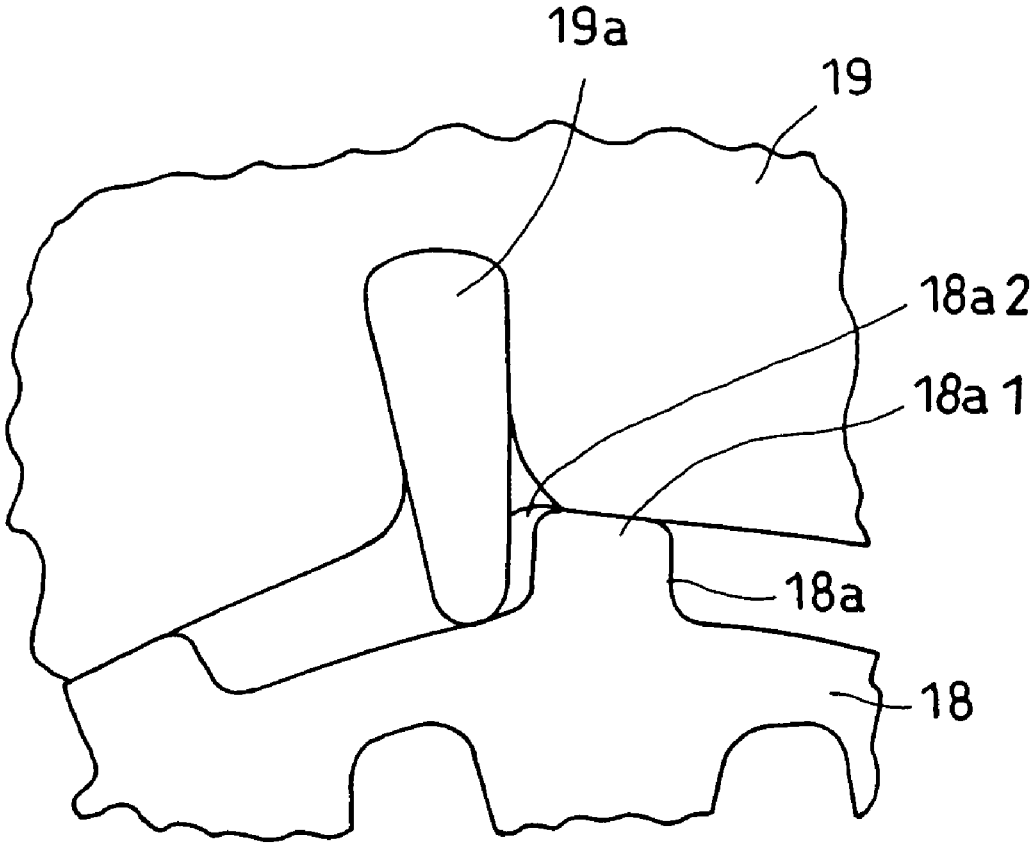
FIG. 3 is an enlarged diagram showing a main portion of FIG. 2.

The rigid body member and the elastic member thus integrally joined is formed in a predetermined shape to form the armature damper 18. In this case, as shown in FIG. 3, the outer peripheral projection 18*a* engaging with the projection 19*a* of the armature stopper 19 is formed in a manner that an elastic member 18*a*2 protrudes from the outer side of a rigid body member 18*a*1.

The outer peripheral projections 18*a* engages with the corresponding projections 19*a* of the armature stopper 19 provided on the outer periphery side of the armature damper, respectively, whereby the armature damper 18 is positioned and held. In this case, as shown in FIG. 3, at the outer peripheral projection 18*a* engaging with the projection 19*a* of the armature stopper 19, the elastic member 18*a*2 protrudes to the outside of the rigid body member 18*a*1. Since the protruded potion of the elastic member functions as a buffer, there does not occur a rattling or appear a space at the engaging portion between outer periphery projection and the projection. Thus, the protruded portion can position and fix the armature damper accurately in a state of no clearance while maintaining the elasticity.

According to the aforesaid configuration, the vibration generated by the abutment to the arm 9 at the time of the printing operation can be absorbed. Thus, even when a durability test is made in which the armature and the arm integrated therewith are moved reciprocatively for about three hundred million strokes or more at a high printing frequency of 2,500 Hz, good test results can be obtained. That is, unlike the conventional technique, there does not arise such a phenomenon that the armature damper 18 deviates from the projection 19*a* of the armature stopper 19 and so damaged.

Further, when the fluorine-contained rubber is used as the elastic member, since the fluorine-contained rubber has excellent durability with respect to the deformation and degradation due to a high temperature, the armature damper 18 can be positionally fixed stably for a long term.

Further, since the armature damper 18 can be accurately positioned by the armature stopper 19 without occurring a rattling, there does not arise such a phenomenon that the armature damper 18 moves due to the vibration caused by the printing operation. Thus, the durability of the parts can be improved. Further, since the arm 9 abuts against the armature damper always at the same position thereof, there does not arise the change of the stroke value of the arm.

At the time of forming the armature damper 18 in a predetermined shape, the punching process using the press processing is preferably used. That is, the rigid body member and the elastic member having been joined integrally are stamped into the predetermined shape by the press processing. In this case, the fluorine-contained rubber as the elastic member deforms elastically and protrudes outside from the rigid body member (stainless material) thus punched, so that the elastic member is sticking out from the outer side of the rigid body member. This tendency appears remarkably at the curved portions such as the outer peripheral projections 18*a*.

In this manner, when the elastic member is adhered integrally to the rear surface of the plate-shaped rigid body member and the thus integrated members are formed into the predetermined shape by the press processing, the elastic member becomes larger in its size and protrudes from the outer side of the rigid body member by about 0.1 to 0.2 mm. Thus, when the protruded portion is used as it is as the buffer at the engaging portion, the manufacturing process can be simplified since a particular process for the buffer is not required.

What is claimed is:

1. An armature damper comprising:

a rigid body member which includes an abutment surface and projections, the abutment surface abutting against an arm having a needle at a tip end thereof thereby to stop a movement of the arm with respect to a movement of an armature in a direction of moving the needle backward, the armature moving the needle via the arm forward and backward, and the projections being protrusively formed at a peripheral portion of the abutment surface and engaging with projections of an armature stopper for positioning, respectively; and an elastic member which is integrally joined to a rear surface of the abutment surface of the rigid body member and formed so as to protrude from outer sides of the projections of the rigid body member.

2. An armature damper according to claim 1, wherein the rigid body member is formed by stainless material, the elastic member is formed by fluorine-contained rubber, and the rigid body member and the elastic member are integrally joined by silane-contained adhesive agent.

3. A dot head comprising:

a plurality of armatures each of which is pivotally supported so as to be rotatable at a base end portion thereof and has an arm that is integrally formed with the armature and has a needle at a tip end thereof, the plurality of armatures being disposed radially in a state that the tip ends thereof are positioned at an inner side thereof, and each of the plurality of armatures rotating around the base end portion serving as a pivotally supporting portion to move the needle forward and backward;

a rigid body member of an armature damper formed in an annular shape so as to oppose to one sides of the respective arms of the plurality of armatures disposed radially, the rigid body member being provided at an outer periphery thereof with a plurality of outer peripheral projections for positioning, and the rigid body member abutting against the one side of the arm when the arm rotates in the backward direction of the needle to stop the arm at a predetermined backward position;

an armature stopper which is disposed in an annular shape at an outer peripheral side of the armature damper and has a plurality of projections engaging with the plurality of outer peripheral projections, respectively; and an elastic member which is integrally joined to a rear surface of the rigid body member of the armature damper, the elastic member being formed to protrude from an outer side of the rigid body member at least at an engaging portion between the projections of the armature stopper and the rigid body member.

* * * * *